United States Patent [19]

Moore

[11] 4,143,252

[45] Mar. 6, 1979

[54] REMOTE CONTROL SWITCH FOR SELECTIVE OPERATION OF MULTIFILAMENT LAMPS

[76] Inventor: Fernley S. Moore, 3419 SE. 22nd Pl., Cape Coral, Fla. 33904

[21] Appl. No.: 832,590

[22] Filed: Sep. 12, 1977

[51] Int. Cl.[2] ..... H01H 9/20

[52] U.S. Cl. ..... 200/5 B; 200/5 E; 200/5 F; 200/50 C

[58] Field of Search ..... 200/5 E, 5 EA, 5 EB, 200/5 F, 50 C, 5 B

[56] References Cited

U.S. PATENT DOCUMENTS

| | | | |
|---|---|---|---|
| 2,790,858 | 4/1957 | Tseng et al. | 200/5 E |
| 3,179,756 | 4/1965 | Feher, Jr. | 200/5 EB |
| 3,646,283 | 2/1972 | Hansen | 200/5 EB |
| 3,659,061 | 4/1972 | Andreaggi | 200/5 EA |

*Primary Examiner*—James R. Scott
*Attorney, Agent, or Firm*—Alfred E. Wilson

[57] ABSTRACT

A remote control comprised of three switches for selective operation of a multifilament incandescent lamp and an "off" switch to break a circuit completed by operation of any one of the three switches. Operation of the first of said three switches completes a circuit to a first filament providing the least light intensity, operation of the second switch completes a second circuit to a second filament to increase the light intensity, and operation of the third switch completes a third circuit to both the first and second filaments to obtain a maximum degree of illumination. Operation of the off switch immediately breaks any one of the three circuits.

9 Claims, 5 Drawing Figures

REMOTE CONTROL SWITCH FOR SELECTIVE OPERATION OF MULTIFILAMENT LAMPS

BACKGROUND OF THE PRESENT INVENTION

Three way or multipole incandescent lamps are conventionally operated must be passed sequentially through a series of three degrees of light intensity before the circuit can be broken to turn the lamp off. There are a variety of disadvantages to this type of operation, for example, when a three way lamp is used as a bed lamp, and the low light intensity is used for reading so as not to disturb a sleeping bed partner, it must be operated through the medium and high intensities before it can be turned off, generally resulting in the awakening of the bed partner by the creation of the sudden sequential increase of light intensity. Additionally, it is more practical and simple to push a single switch actuator to obtain a desired degree of illumination and a second switch actuator to turn the lamp off than to run through a sequence of four switching operations everytime the three way lamp is operated from "off" to "on" and back "off".

The switch and electric conductor arrangement to a conventional multifilament lamp as provided by the present invention permits a selected light intensity operation of the lamp by the manipulation of one of three switch actuators and an operation back to an "off" position by the manipulation of one single switch actuator regardless of which of the three "on" switch actuators was manipulated. However, the light intensity may be selectively varied at any time by the operation of another one of the three "on" switch actuators.

Therefore, one of the principal objects of the present invention is to provide remote control means comprised of three "on" switches for selective operation of a multifilament incandescent lamp and a single "off" switch to break the circuit completed by operation of any one of the three "on" switches.

Another object of the invention is to provide means to interconnect the three "on" switches whereby manipulation of a second of the "on" switches to an "on" position automatically breaks the circuit completed by the operation of a first "on" switch and returns the first switch to an "off" position.

A further object of the invention is to provide means to prevent the operation of more than one "on" switch to an "on" position at one time.

A still further object of the invention is to provide electric circuit means directly from the source of electricity to the remote control switches and to the filaments in a multifilament lamp in a manner so as to selectively produce three individual light intensities as determined by the selective operation of the three "on" switches.

Yet another principal object of the present invention is to provide remote control switch means for a multifilament lamp which is very simple in construction and very inexpensive to manufacture.

DETAILED DESCRIPTION OF THE DRAWINGS

Figure 1:
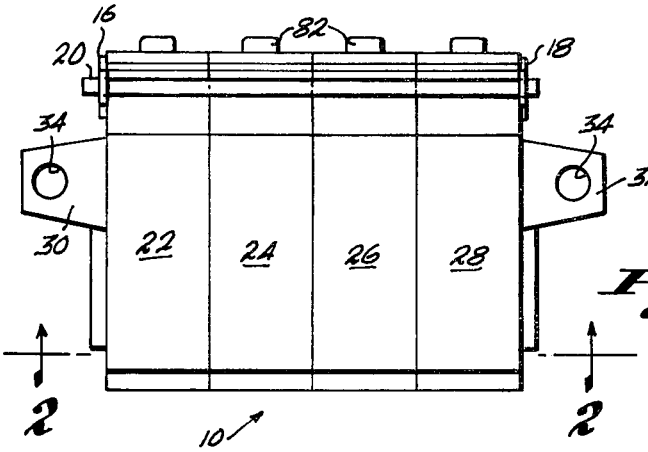
FIG. 1 is a top plan view of the remote control switch means of the present invention.
Figure 2:
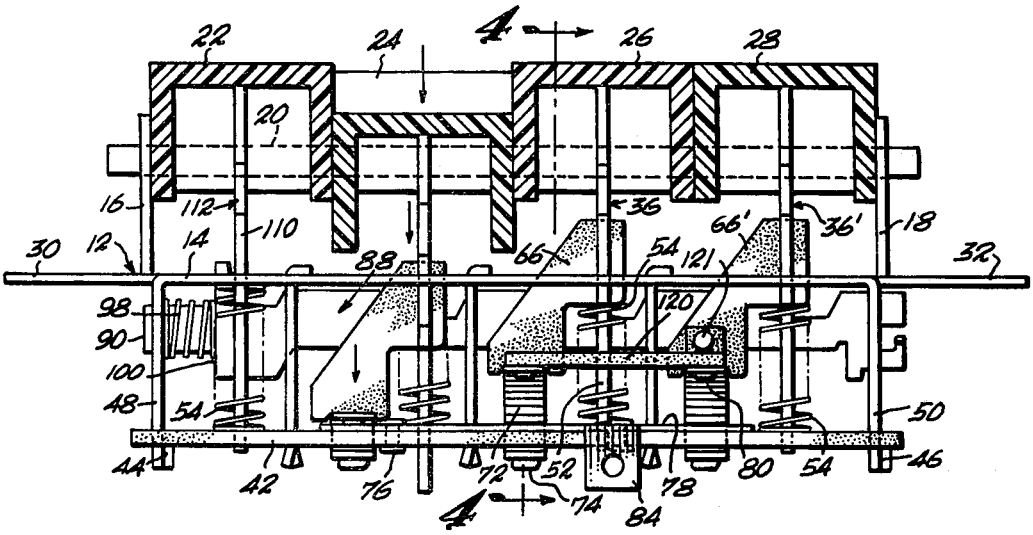
FIG. 2 is a longitudinal, vertical sectional view taken along line 2—2 of FIG. 1.

With reference to the drawings in which like reference characters designate like or corresponding parts throughout the various views and with particular reference to FIGS. 1 and 2, the remote control switch assembly is indicated generally at 10 and includes a main support bracket 12 which includes an elongated longitudinally extending base portion 14 and upstanding ears 16 and 18 from opposed ends thereof. A longitudinally extending pivot rod 20 is carried by ears 16 and 18 for pivotal engagement by four switch actuators, an "off" switch actuator 22 and three "on" switch actuators 24, 26 and 28. The assembly 10 may be disposed in any type of appropriate portable housing, or opposed longitudinally extending ears 30, 32 from base portion may be employed as attachment means by means of holes 34 and appropriate screws or the like (not shown).

Figure 4:
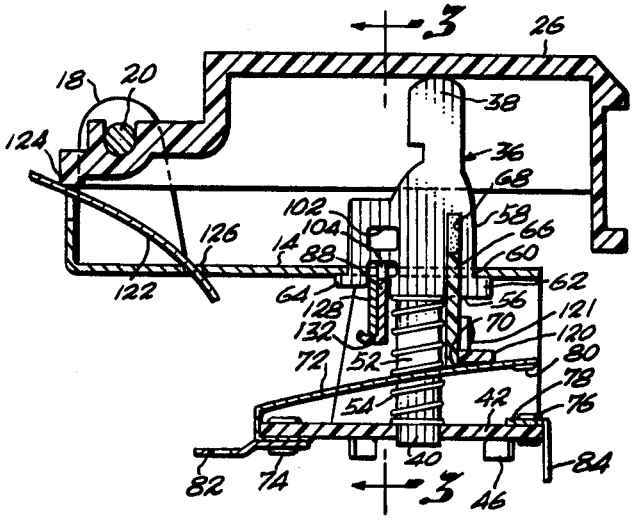
FIG. 4 is a transverse, vertical sectional view taken along line 4—4 of FIG. 2.

With particular reference to FIGS. 2 and 4, each "on" switch actuator such as 26 is associated with a vertically disposed lock plate 36, the upper end 38 of which is engaged against the bottom surface of actuator 26, the lower end 40 being vertically slidably engaged through a bottom longitudinal insulation plate 42, carried in fixed relation at 44, 46 between a pair of downwardly extending legs 48, 50 from opposed ends of base portion 14. The lower end portion 52 of each lock plate 36 is of a reduced width and a compression spring 54 is circumposed thereabout between insulation plate 42 and a shoulder 56 of lock plate 38, defined by an enlarged central portion 58 thereof.

As best illustrated in FIG. 4, the enlarged central portion 58 is slidably engaged through a slot 60 in base portion 14 and a pair of oppositely, outwardly disposed lugs 62, 64 therefrom engage under base portion 14 to limit the upward movement of lock plate 36. A generally angle shaped vertically extending insulation plate 66 is fixed to each lock plate 36 as by being press fitted into a slot 68 therein. A bottom edge 70 of insulation plate 66 is normally positioned against an elongated spring conductor 72 fixed as by a rivet 74 to the rear edge portion of insulation plate 42. Fixed as by rivets 76 along the top front edge portion of insulation plate 42 is an elongated switch contact and conductor plate 78 which is engaged by a contact button 80 fixed to the front extended end of each spring conductor 72 when an actuator such as 26 is manually depressed against the forces of a compression spring 54. A terminal 82 is fixed relative to each spring conductor 72 by rivet 74 along the rear edge of insulation plate 42 and a terminal 84 is bent downwardly from contact and conductor plate 78 for fixed engagement by a common conductor wire as will hereinafter be described relative to FIG. 5. As illustrated in FIG. 2 the contact conductor plate 78 is elongated for contact by contact buttons 80 of all three spring conductors 72 associated with the respective switch actuators 24, 26 and 28; actuator 24 being illustrated in its depressed position in FIG. 2 to complete a circuit in a manner to be subsequently described.

Figure 3:
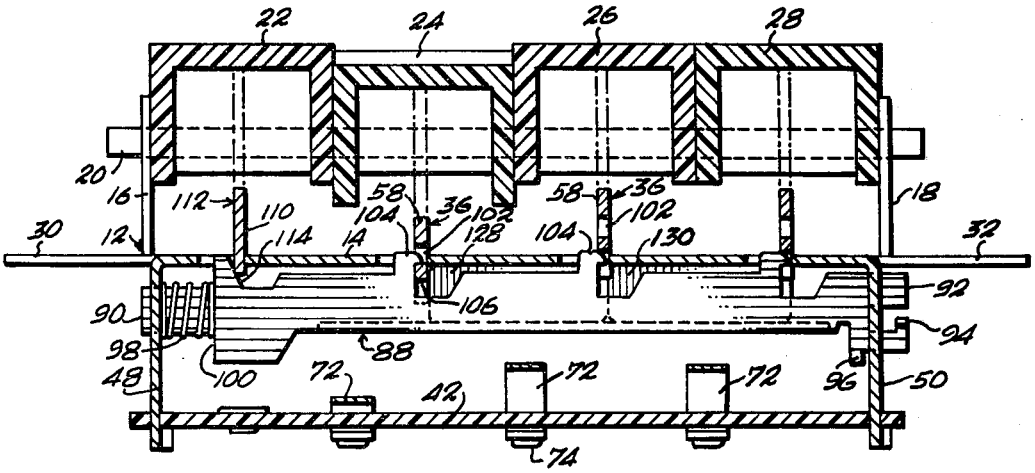
FIG. 3 is a longitudinal, vertical sectional view taken along line 3—3 of FIG. 4.

When a switch actuator such as 24 is depressed, it is locked in its down position by a longitudinal sliding latch bar 88 as seen in FIG. 3. Latch bar 88 is slidably engaged between the legs 48, 50. For this purpose a reduced width portion 90 is provided at a first end thereof for sliding engagement through an appropriate slot in leg 48 and an enlarged end portion 92 is formed at a second end thereof for sliding engagement through an appropriate slot in leg 50. However the enlarged end portion is formed to provide an outer upwardly extending lug 94 which is twisted in a manner so as to limit the movement of latch bar 88 to the left as seen in FIGS. 2 and 3 and an inner downwardly extending lug 96 to limit the movement of latch bar 88 to the right. A compression spring 98 is circumposed about the reduced width portion 90 of latch bar 88 between leg 48 and shoulder means 100 formed thereon. Therefore, latch bar 88 is biased to the right as seen in FIGS. 2 and 3.

The enlarged central portion 58 of each vertical lock plate 38 is provided with a through hole 102, positioned to receive a lock pawl 104 formed atop latch bar 88 relative to each lock plate 38. All of the vertical lock plates 36 are normally biased upwardly by compression springs 54 to position the holes 102 therein above the lock pawls 104 as illustrated relative to switch actuators 26, 28. However, when one switch actuator such as 24 is depressed, the edge 106 thereof first engages the rounded top edge of the associated pawl 104 and cams it momentarily to the left as seen in FIG. 3 until the hole 102 in lock plate 38 is positioned to be lockingly engaged by said pawl 104 under the influence of compression spring 98.

Subsequent depression of either switch actuator 26 or 28 will simultaneously release the lock plate 38 of switch actuator 24 under the influence of a compression spring 54 and lockingly engage the lock plate 38 of the depressed switch actuator 26 or 28 in the above described manner. When the "off" switch actuator 22 is depressed, the enlarged central portion 110 of a vertical slide plate 112, similar to a lock plate 38, contacts a cam surface 114 formed in latch bar 88 moving said latch bar to the left as seen in FIGS. 2 and 3 to disengage any one of the lock plates 38 by means of a respective compression spring 54.

FIGS. 2 and 4 illustrate an insulation adaptor 120, fixed at 121 to the vertically extending insulation plate 66' fixed to lock plate 36' of switch actuator 28. Adaptor 120 extends longitudinally to engage and depress the spring conductor 72 of switch actuator 26 into engagement with contact conductor plate 78 simultaneous to contact of spring conductor 72' with contact conductor plate 78 when actuator 28 is depressed. Therefore, two circuits will be completed to the multifilament lamp when switch actuator 28 is depressed in a manner to be subsequently described. A leaf spring 122 engages between the rear end 124 of each switch actuator 22, 24, 26 and 28 and a hole 126 in base portion 14 to maintain said actuators in engagement with the top end 38 of lock plates 36.

A pair of lock-out plates 128, 130 are slidably engaged in a track 132, FIGS. 3 and 4 behind the latch bar 88 in a generally conventional manner to permit operation of only one switch actuator 24, 26 and 28 at a time. The plates 128, 130 are moved by operation of any one switch actuator to lock out movement of the other two.

Figure 5:
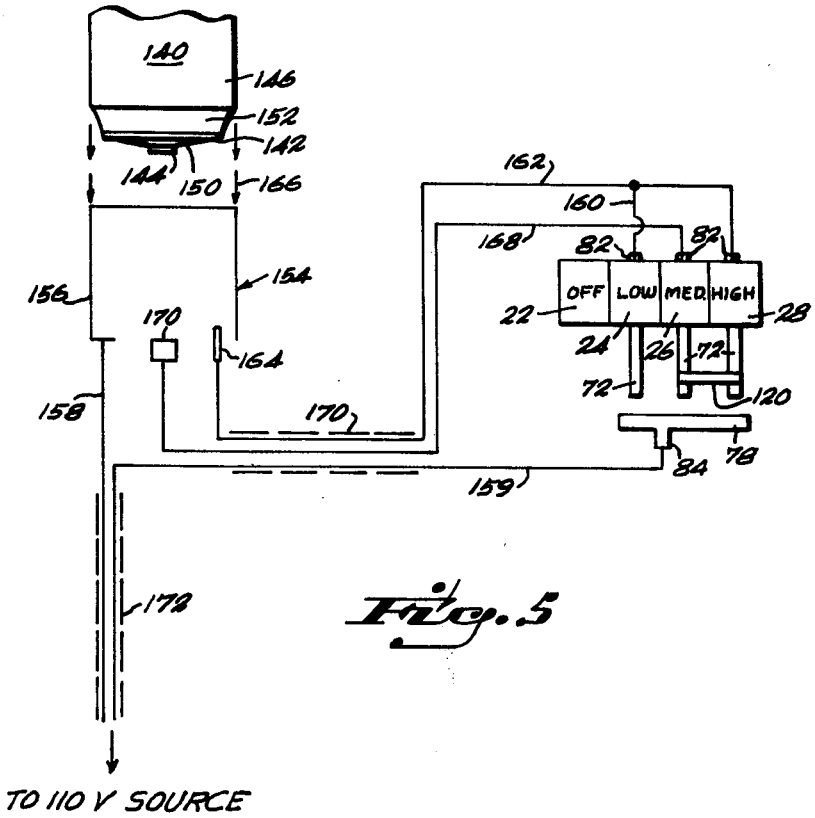
FIG. 5 is an electrical schematic of the connection between the remote control switch means to an energy source and a receptacle for a multifilament incandescent lamp.

With reference to FIG. 5, the screw-in plug of a conventional multi-filament lamp is designated generally at 140. Conventional lamps of this type provide two filaments, not illustrated, a first filament provides a low intensity light, the second a medium intensity light and the combination of the first and second filaments provides a high intensity light. Three electric contact surfaces are provided by plug 140, the ring contact 142 comprises the first contact to the first, low intensity filament, the central button 144, the second contact to the medium intensity filament and the plug shell 146 the third, common return contact from both filaments. The three contacts are insulated from each other at 150, 152.

The lamp receptacle is indicated generally at 154 and the shell 156 thereof comprises a common contact from plug shell 146 to conductor 158 back to a 110V source. In operation, when the low actuator 24 depresses a circuit is completed through a conductor 159 from the 110V source, through terminal 84, contact and conductor plate 78, a spring conductor 72, terminal 82 and conductors 160, 162 to a contact 164 which engages ring contact 142 to complete a circuit to the first, low intensity filament when the lamp plug is engaged in the socket shell 156 as indicated by arrows 166.

When the medium actuator 26 is depressed a circuit is completed through conductor 159 from the source, through terminal 84, plate 78, spring conductor 72 of actuator 26, a terminal 82 and a conductor 168 to a contact 170 which engages the central button contact 144 to complete a circuit to the medium intensity filament.

When the high actuator 28 is depressed, a circuit is completed to the low intensity filament through conductor 162 in the same manner as described relative to the depression of the low actuator 24, and the adaptor arm 120 simultaneously completes a circuit to the medium intensity filament through conductor 168 as above described relative to the depression of the medium actuator 26. In this manner both filaments are activated to achieve a high intensity light. Broken lines 170 indicate the extension cord from the switch assembly 10 to the multifilament lamp socket 154 and broken lines 172 indicate the extension cord to a 110V source.

I claim:

1. A remote control push actuated switch assembly for a multifilament incandescent lamp to selectively complete electric circuits thereto to achieve low, medium or high intensities of illumination comprising, a frame including a main base portion providing opposed ends, a pair of upstanding ears and a pair of downwardly extending legs from said opposed ends;

a plurality of individually depressable switch actuators and an elongated pivot rod carried by said ears and extending therebetween with said switch actuators pivotally carried thereon;

an insulation plate fixed relative to lower ends of said legs and extending therebetween, an elongated contact and conductor plate fixed to said insulation plate including a first terminal, said plurality of individually depressable switch actuators comprises first, second and third "on" switch actuators and an "off" switch actuator and including an elongated spring conductor associated with and positioned relative to each of said "on" switch actuators, including a first end provided with a contact means and second end provided with a second terminal fixed to said insulation plate.

means operated by said first, second and third "on" switch actuators to complete a first circuit from an appropriate electrical source to a first filament of the multifilament lamp, when said first "on" switch actuator is depressed, a second circuit to a second filament of the multifilament lamp when said second "on" switch actuator is depressed and a third circuit to the first and second filaments when said third "on" switch actuator is depressed;

means to automatically lock any one of said first, second or third switch actuators in its depressed position;

means to release any one of said first, second or third "on" switch actuators from its depressed position when a second switch actuator is depressed;

adaptor means to interconnect said third "on" switch actuator with said second "on" switch actuator to complete said third circuit;

means to release any one of said "on" switch actuators from its depressed position when said "off" switch actuator is depressed.

2. The switch assembly as defined in claim 1 wherein said means operated by said first, second and third switch actuators includes a vertically extending lock plate for each of said switch actuators slidably engaged through appropriate slots in said main base portion and insulation plate, each lock plate including an upper end portion for engagement against the underside of one of said switch actuators, an enlarged central portion with a through hole, stop means to limit its upward movement, and a lower portion and compression spring means circumposed thereabout, normally biasing said lock plate from a down position to an up position.

3. The switch assembly as defined in claim 2 including a longitudinally extending latch bar slidably engaged through said pair of downwardly extending legs and spanning the distance therebetween, and including an upwardly extending pawl therefrom for each of said lock plates comprising said means to automatically lock, and compression spring means normally biasing said latch bar to a first longitudinal position, said pawls being located relative to the respective lock plates whereby depression of any one of said switch actuators will cause one of said vertical lock plates to move to its down position and said latch bar to momentarily slide to a second longitudinal position permitting the pawl associated with its lock plate to engage in said enlarged central portion hole when said latch bar is biased back to said first position by said compression spring means, thereby locking anyone of said depressed switch actuators in a depressed position.

4. The switch assembly as defined in claim 3 wherein each of said lock plates of said first and second switch actuators includes an insulator portion provided with a lower edge to engage one of said spring conductors, when said first or second switch actuator is depressed, and to bias said contact means thereof into engagement with said contact and conductor plate to complete said first or second circuit.

5. The switch assembly as defined in claim 4 wherein said lock plate of said third switch actuator includes an insulator portion provided with a lower edge to engage one of said spring conductors when said third switch actuator is depressed and to bias said contact means thereof into engagement with said contact and conductor plate, and a horizontally extending insulator finger comprising said adaptor means to engage and to similarly depress the spring conductor associated with said second switch actuator to complete said third circuit.

6. The switch assembly as defined in claim 3 including a vertically extending plate beneath said "off" switch actuator comprising said means to release, said plate being slidably engaged through appropriate slots in said main base portion and insulation plate, said latch bar including a cam surface and said plate including an abutment portion to engage said cam surface when said "off" switch actuator is depressed to bias said latch bar to said second longitudinal position causing the disengagement of any one of said pawls from its locked position relative to its associated lock plate.

7. The switch assembly as defined in claim 6 including compression spring means normally biasing said plate and "off" switch actuator to an up position.

8. The switch assembly as defined in claim 2 including lock-out means to permit the depression of only one of said switch actuators at a time.

9. The switch assembly as defined in claim 8 including track means and said lock-out means comprises a pair of slide plates in said track means in positions for engagement by downward movement of any one of said lock plates to move said pair of slide plates in a manner so as to block the downward movement of the other two lock plates.

* * * * *